US005806860A

United States Patent [19]

Conte

[11] Patent Number: 5,806,860

[45] Date of Patent: Sep. 15, 1998

[54] FRAME FOR SKATES WITH ALIGNED WHEELS

[75] Inventor: Gino Conte, Caerano San Marco, Italy

[73] Assignee: Roces S.R.L., Italy

[21] Appl. No.: 254,112

[22] Filed: Jun. 6, 1994

[30] Foreign Application Priority Data

Aug. 2, 1993 [IT] Italy ..... TV93A0072

[51] Int. Cl.[6] ..... A63C 17/06

[52] U.S. Cl. ..... 280/11.22; 280/809; 280/811

[58] Field of Search ..... 280/11.19, 11.22, 280/11.23, 11.27, 11.2, 809, 811, 11.21

[56] References Cited

U.S. PATENT DOCUMENTS

| | | | |
|---|---|---|---|
| 931,064 | 8/1909 | Hollar | 280/11.19 |
| 2,168,820 | 8/1939 | Edstrom | 280/11.19 |
| 3,086,787 | 4/1963 | Wyche | 280/11.19 |
| 4,070,029 | 1/1978 | Panarelli | 280/11.19 |
| 4,214,768 | 7/1980 | Dominy et al. | 280/809 |
| 4,273,345 | 6/1981 | Ben-Dor et al. | 280/11.2 |
| 4,323,259 | 4/1982 | Boudreau | 280/11.23 |
| 4,932,676 | 6/1990 | Klamer | 280/11.21 |
| 5,183,276 | 2/1993 | Pratt | 280/809 |
| 5,234,230 | 8/1993 | Crane et al. | 280/811 |
| 5,239,941 | 8/1993 | Chibi | 280/11.2 |
| 5,630,624 | 5/1997 | Goodman | 280/11.22 |

OTHER PUBLICATIONS

Box Magazine, Fall '93, p. 35.

*Primary Examiner*—J. J. Swann
*Assistant Examiner*—Frank Vanaman
*Attorney, Agent, or Firm*—R. Neil Sudol; Henry D. Coleman

[57] ABSTRACT

A frame for a skate has a base, on which a shoe can be associated, and two wings for supporting two or more pivots for the wheels. A protective plate is slidingly and selectively associated with the two wings of the frame and can be interposed between two adjacent wheels. It is thus possible to provide optimum protection of the frame against impacts during sports practice.

8 Claims, 2 Drawing Sheets

FRAME FOR SKATES WITH ALIGNED WHEELS

BACKGROUND OF THE INVENTION

1. Field of the Invention

The present invention relates to a frame for skates with aligned wheels.

2. Description of the Prior Art

Conventional skates include a frame which is composed of a base on which a shoe can be associated and from which two wings protrude downward, supporting two or more pivots for the wheels.

A problem for the user is the fact that during use the frame of the skate, and particularly the two wings, are subjected to deformation and breakage due to scraping, for example, at the curbs of sidewalks.

It is in fact customary, especially for younger users who seek the most unconventional and extreme uses of the skates, to perform acrobatic maneuvers that entail the scraping of the frame on sidewalk curbs or on artificial obstacles.

Repeated passing over such obstacles leads to rapid wear if not breakage of the two wings of the frame and to their deformation, which affects the correct arrangement of the wheel axes.

The aim of the present invention is therefore to solve the described drawback by providing a frame which is as much as possible protected against improper uses that entail scraping passes over rigid bodies.

An object is to provide a frame in which the above characteristic can optionally be restored rapidly and easily by the user.

An important object is to provide a frame that is simple and easy to industrialize.

Another object is to provide a frame that has very low manufacturing costs that allow its widespread diffusion.

SUMMARY OF THE INVENTION

This aim, these objects and others which will become apparent from the following description are achieved by a frame for skates with aligned wheels, composed of a base, on which an item of footgear is associable, and of two wings for supporting two or more pivots for the wheels, characterized in that at least one protective plate is slidingly and selectively associable with the two wings and can be interposed between two adjacent wheels.

Further characteristics and advantages of the invention will become apparent by the following description of a preferred but not exclusive embodiment of a frame according to the invention, illustrated only by way of a non limiting example in the accompanying drawings.

DESCRIPTION OF A PREFERRED EMBODIMENT OF THE INVENTION

Figure 1:
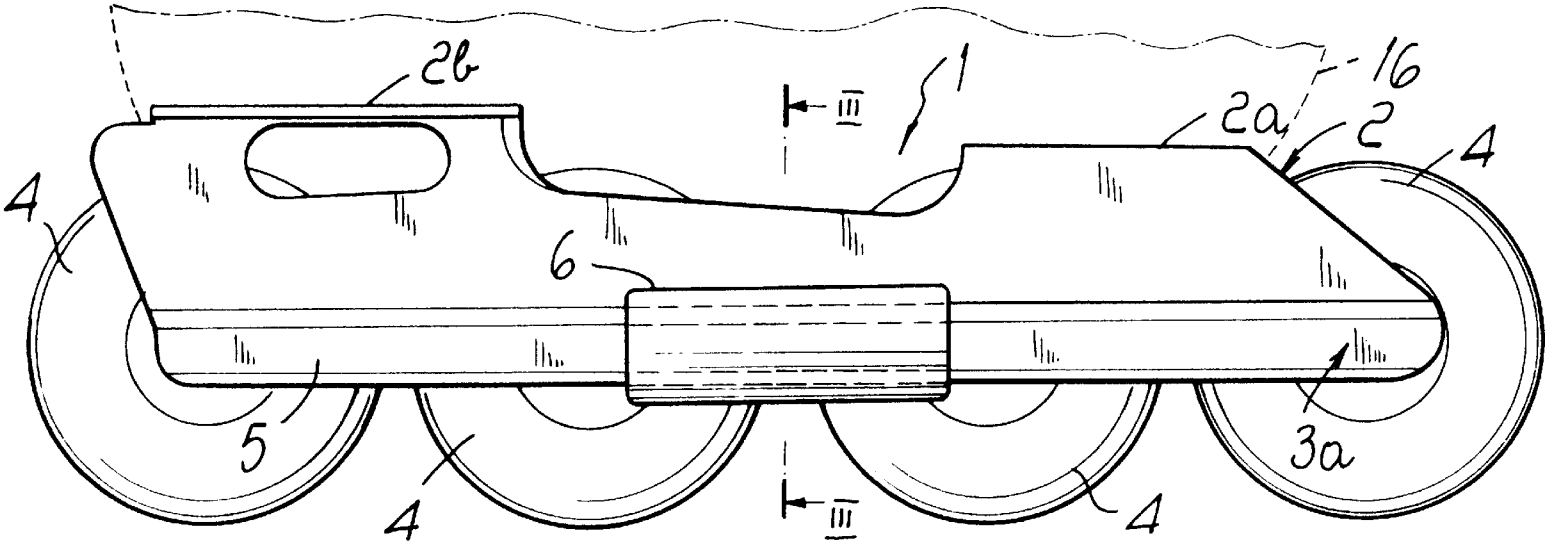
FIG. 1 is a side view of the frame.
Figure 2:
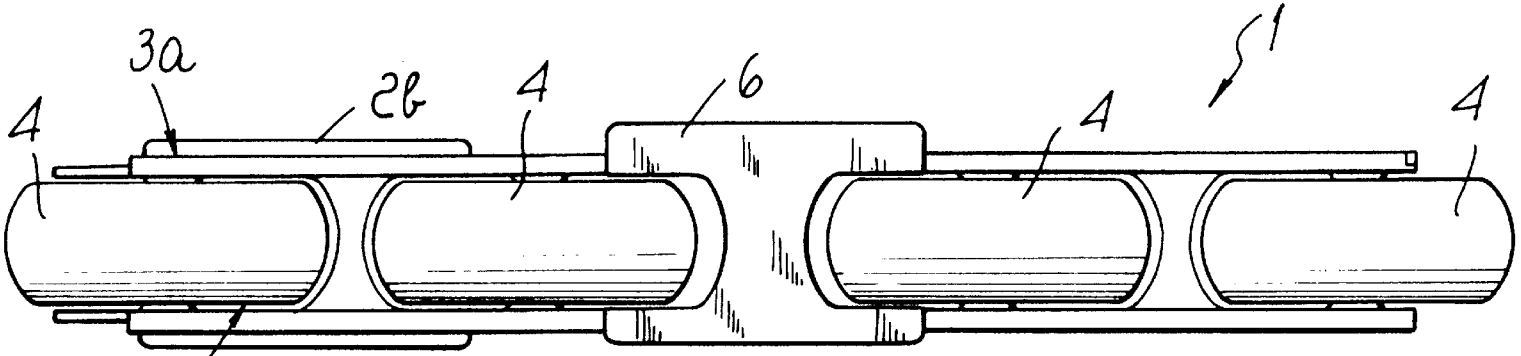
FIG. 2 is a bottom view of the frame.
Figure 3:
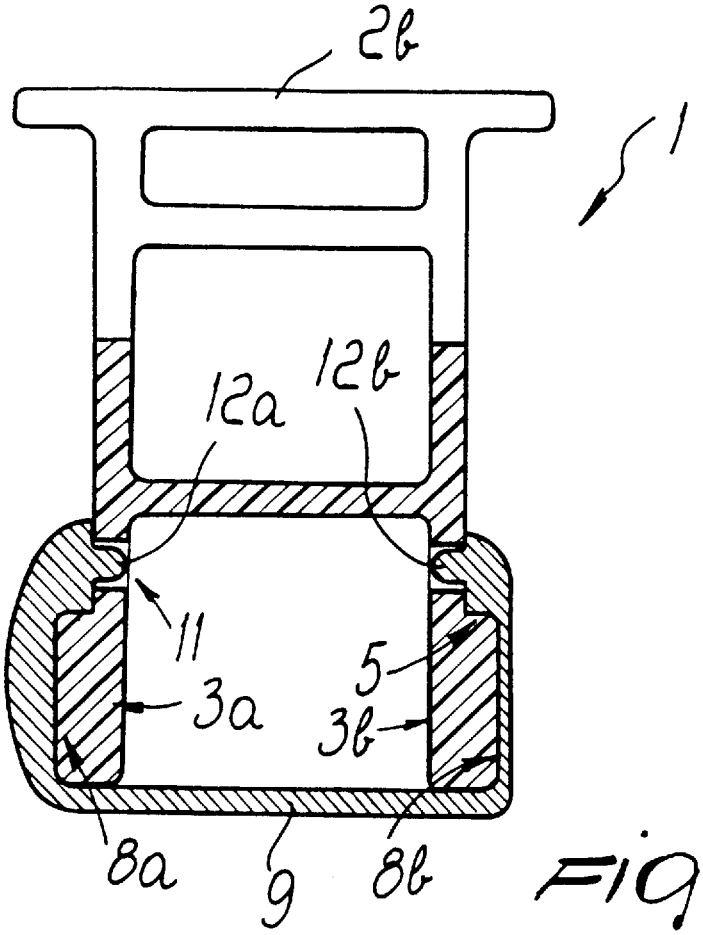
FIG. 3 is a sectional view of the frame, taken along the plane III—III of FIG. 1.
Figure 4:
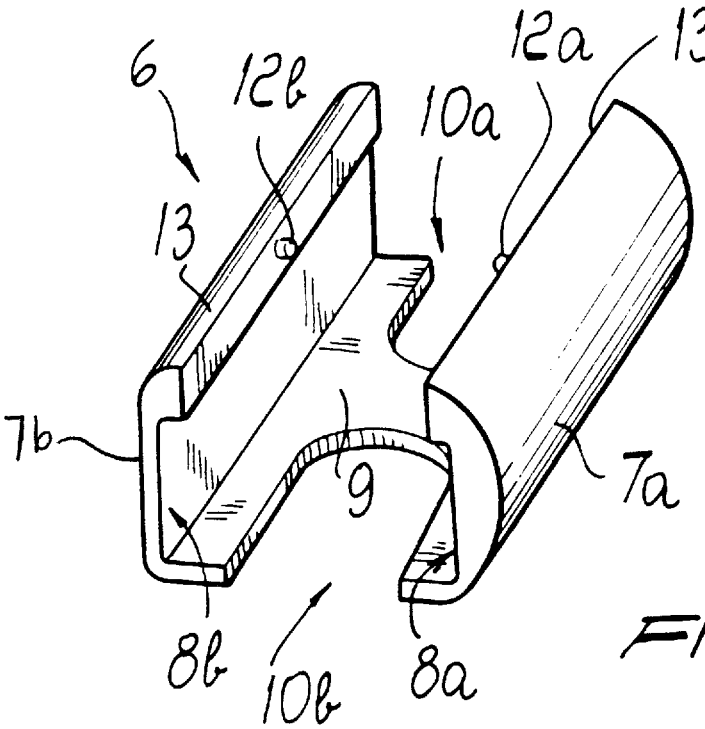
FIG. 4 is a perspective view of the protective plate.

With reference to the figures, the numeral 1 designates the frame, which is constituted by a base 2 formed by a front half-base 2*a* and by a rear half-base 2*b*. A shoe 16, is associable with the base.

Two wings 3*a* and 3*b* protrude below the half-bases 2*a* and 2*b* and support two or more pivots for wheels 4 which are thus mutually aligned.

At least one longitudinal ridge 5 is formed proximate to the lower edge on each one of the outer lateral surfaces of the two wings 3*a* and 3*b* and forms a guide for the sliding arrangement of at least one plate 6 which is essentially C-shaped.

The plate 6 also has two wings 7*a* and 7*b* in which a seat 8*a* and 8*b* is formed. The seat is shaped complementarily with respect to the longitudinal ridges 5, so as to allow the insertion of the plate, preferably in the median region of the frame 1, once the front or rear wheels have been removed.

The two wings 7*a* and 7*b* of the plate 6 are connected by a base 9 on which two recesses 10*a* and 10*b* are formed which prevent interaction with the wheels 4 once the plate 6 has been positioned.

The position of the plate can also be selected by the user.

To this purpose, multiple pairs of coaxial through holes 11 are formed on the two wings 3*a* and 3*b* of the frame 1. Teeth 12*a* and 12*b* protrude inside the pair of wings 7*a* and 7*b* of the frame 1 proximate to the perimetric edge 13. The teeth 12*a*, 12*b* can be arranged at these holes.

It has been seen in practice that the frame has achieved the intended aim and all objects, since it allows to protect the frame, and particularly the wings thereof, against improper uses that entail scraping passes over rigid bodies.

The used plate can also be easily replaced by the user himself when required.

Of course, the materials used to form the parts of the frame, as well as the dimensions of the individual components of the frame, may vary according to the requirements.

I claim:

1. A frame for skates with aligned wheels, comprising:

a base connectable to a shoe, said base being provided with two wings for supporting pivots for the wheels;

at least one protective plate slidingly coupled to said two wings between two adjacent ones of said wheels, each of said wings having a lower edge and longitudinal guide means extending proximate to said lower edge for slidably coupling said plate to said wings so that said plate is repositionable longitudinally at any one of a plurality of positions along said wings.

2. The frame according to claim 1 wherein said guide means comprises a longitudinal ridge provided on the respective one of said wings and proximate to said lower edge of the respective one of said winos, said plate being substantially C-shaped and comprising two side portions and a center portion, each of said side portions having a longitudinal seat adapted to accommodate a respective one of the ridges.

3. The frame according to claim 2 wherein said center portion of said plate has a front recess and a rear recess adapted to prevent said wheels from interfering with said plate as said plate slides along said wings between said wheels.

4. The frame according to claim 3 wherein at least one tooth is provided on one of said side portions of said plate proximate to the respective seat, said tooth being adapted to engage in any one of a plurality of holes provided on a respective one said wings proximate to the respective ridge.

5. A frame for skates with aligned wheels, comprising:

a base connectable to a shoe, said base being provided with two wings for supporting pivots for the wheels;

at least one protective plate slidingly coupled to said two wings between two adjacent ones of said wheels, each of said wings having a lower edge and a longitudinal ridge extending proximate to said lower edge for slidably coupling said plate to said wings so that said plate is repositionable longitudinally at any one of a plurality of positions along said wings.

6. The frame according to claim 5 wherein said plate is substantially C-shaped and comprises two side portions and a center portion, each of said side portions having a longitudinal seat adapted to accommodate a respective one of the ridges.

7. The frame according to claim 6 wherein said center portion of said plate has a front recess and a rear recess adapted to prevent said wheels from interfering with said plate as said plate slides along said wings between said wheels.

8. The frame according to claim 7 wherein at least one tooth is provided on one of said side portions of said plate proximate to the respective seat, said tooth being adapted to engage in any one of a plurality of holes provided on a respective one said wings proximate to the respective ridge.

* * * * *